US007797791B2

(12) United States Patent
White et al.

(10) Patent No.: US 7,797,791 B2
(45) Date of Patent: Sep. 21, 2010

(54) VACUUM WITH PANEL FILTER

(75) Inventors: Paul S. White, Towson, MD (US); Michael P. Kunz, Hampstead, MD (US); Gregg L. Sheddy, Towson, MD (US); Stuart J. Wright, Timonium, MD (US); Spencer G. Maid, Hartland, WI (US); David E. Scheerer, Glen Mills, PA (US)

(73) Assignee: Black & Decker Inc., Newark, DE (US)

( * ) Notice: Subject to any disclaimer, the term of this patent is extended or adjusted under 35 U.S.C. 154(b) by 78 days.

(21) Appl. No.: 11/870,822

(22) Filed: Oct. 11, 2007

(65) Prior Publication Data

US 2008/0115315 A1 May 22, 2008

Related U.S. Application Data

(60) Provisional application No. 60/859,944, filed on Nov. 20, 2006.

(51) Int. Cl.
*A47L 9/10* (2006.01)

(52) U.S. Cl. ..... 15/347; 15/352; 15/353

(58) Field of Classification Search ..... 15/352, 15/353, 347, 339, 327.1, 327.2, 327.6, 327.7; 55/478, 480, 529, 357, 467, 274, 470–473
See application file for complete search history.

(56) References Cited

U.S. PATENT DOCUMENTS 3,570,222 A 3/1971 Dudek et al.
4,356,591 A 11/1982 Lude et al.
4,776,060 A * 10/1988 Chang ..... 15/339
5,150,499 A * 9/1992 Berfield ..... 15/327.1
5,829,092 A 11/1998 Hobbs
6,210,469 B1 4/2001 Tokar
6,536,075 B1 3/2003 Bonnet et al.
6,543,085 B2 4/2003 Holsten et al.
6,934,994 B2 8/2005 Oh et al.
7,008,465 B2 3/2006 Graham et al.
7,105,034 B2 9/2006 Jung et al.
7,134,165 B2 11/2006 Pullins
7,185,394 B2 3/2007 Hafling et al.
7,235,121 B2 * 6/2007 West ..... 95/273
7,337,492 B2 * 3/2008 Matsuno et al. ..... 15/326
2003/0167590 A1 9/2003 Oh
2004/0074042 A1 4/2004 Overvaag
2004/0088817 A1 5/2004 Cochran et al.
2004/0194249 A1 10/2004 Lee et al.
2005/0022337 A1 2/2005 Roney et al.
2005/0138762 A1 6/2005 West
2005/0155177 A1 * 7/2005 Baer et al. ..... 15/353
2006/0067843 A1 3/2006 Liffers et al.
2006/0191099 A1 * 8/2006 Fry et al. ..... 15/353
2006/0277712 A1 12/2006 Kim et al.

* cited by examiner

*Primary Examiner*—Dung Van Nguyen
(74) *Attorney, Agent, or Firm*—Harness, Dickey & Pierce, P.L.C.

(57) ABSTRACT

A vacuum is provided with a removable filter tray that allows a user to access the filter without having to disassemble the vacuum. The filter can then be changed or cleaned and easily replaced without disassembly of the vacuum.

11 Claims, 7 Drawing Sheets

VACUUM WITH PANEL FILTER

CROSS-REFERENCE TO RELATED APPLICATIONS

This application claims the benefit of U.S. Provisional Application No. 60/859,944, filed on Nov. 20, 2006. The disclosure of the above application is incorporated herein by reference.

FIELD

The present disclosure relates to vacuum filters, and more particularly, to a vacuum having a panel filter that is removable externally of the vacuum to allow easy cleaning and replacement of the filter panel without disassembly of the vacuum.

BACKGROUND AND SUMMARY

The statements in this section merely provide background information related to the present disclosure and may not constitute prior art.

Vacuums, particularly industrial shop vacuums may be equipped with a filter unit which is attached directly to an inlet passage of the vacuum head that is connected to the vacuum source. In order to access this vacuum filter, the vacuum head must be removed from the canister. Then, the vacuum filter must be either removed, or cleaned while mounted securely to the vacuum head. Cleaning and/or removing the filter can be cumbersome and messy.

The present disclosure provides a vacuum including a housing defining a suction inlet opening and a debris chamber in communication with the suction inlet opening. A vacuum pressure source is disposed in the housing for providing a vacuum pressure to the suction inlet opening. A removable filter tray is accessible from the exterior of the housing and is disposed in an airflow path between the suction inlet opening and the vacuum pressure source.

According to other aspects of the present disclosure, the removable filter tray can be inserted at an angle between 10 and 30 degrees relative to horizontal so that the filter tray can extend partially into the housing canister. The vacuum pressure source can include an electric motor operable to drive an impeller. The electric motor and the impeller can be disposed in the housing for providing a vacuum pressure to the suction inlet opening and a drive shaft of the electric mower can be angled between 10 and 30 degrees from vertical in order to correspond to an angled orientation of the removable filter tray within the vacuum head.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
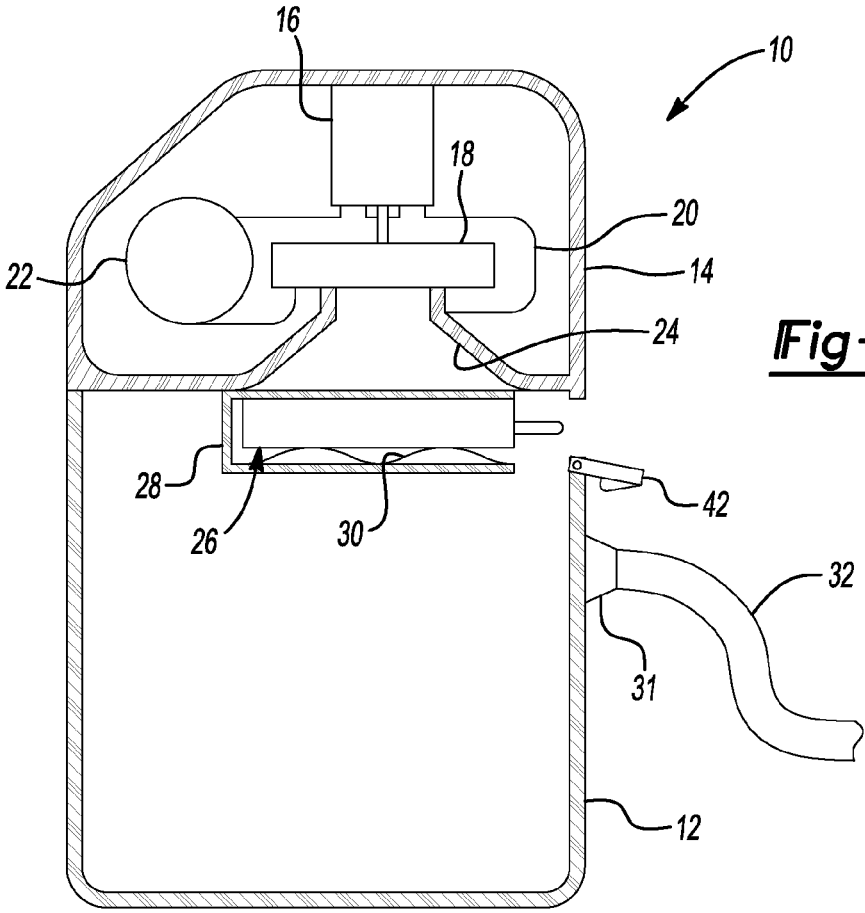
FIG. 1 is a schematic-sectional view of a shop vacuum according to the principles of the present disclosure.

The following description is merely exemplary in nature and is not intended to limit the present disclosure, application, or uses. It should be understood that throughout the drawings, corresponding reference numerals indicate like or corresponding parts and features.

With reference to FIGS. 1-4, an example vacuum 10 according to the principles of the present disclosure will now be described. The vacuum 10 may include a canister 12 and a vacuum head 14 that closes the canister 12. The vacuum head may support a drive motor 16. The drive motor 16 may support a suction fan 18, which may be provided in a fan chamber 20 of the vacuum head 14. The fan chamber 20 may be in fluid communication with an exhaust port 22 and an intake port 24. The intake port 24 may be covered by a filter assembly 26 situated in a filter housing 28 of the vacuum head 14. The filter housing 28 may include ramps 30 that may influence the filter assembly 26 toward and into sealed engagement with an opening of the intake port 24.

The motor 16, when powered up, may rotate the suction fan 18 to draw air into the suction inlet opening 31 and through the canister 12, through the filter assembly 26, through the intake port 24 and into the fan chamber 20. The suction fan 18 may push the air in the fan chamber 20 through the exhaust port 22 and out of the vacuum 10. A hose 32 can be attached to the inlet opening 31.

Figure 2:
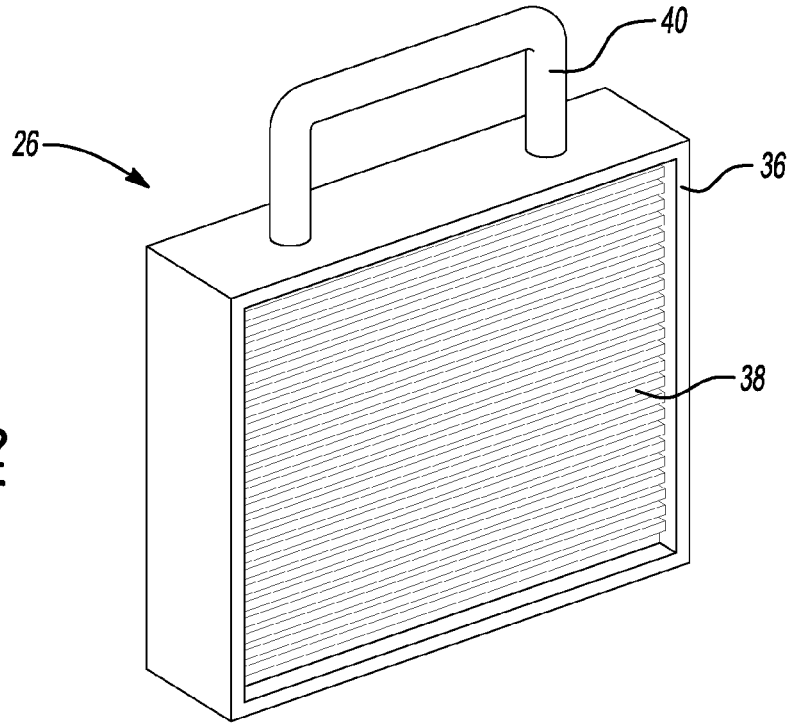
FIG. 2 is a perspective view of a removable filter tray according to the principles of the present disclosure.

With reference to FIG. 2, the filter assembly 26 may include a frame 36 supporting a panel filter 38. In the disclosed embodiment, the panel filter 38 may be a corrugated paper filter. In alternative embodiments, the panel filter 38 may be fabricated from numerous and alternative materials that are well known in the art. The panel filter 38 may include an input side that faces away from the intake port 24 and an output side that faces into the intake port 24.

As shown, the frame 36 may include a handle 40. In this example embodiment, the frame 36 and the handle 40 may be of a unitary one-piece construction. In alternative embodiments, the frame 36 and the handle 40 may be separate and distinct components that are assembled together. The frame 36 may be fabricated from a material with sufficient rigidity to allow a user to grasp the handle 36 and shake and or bang the filter assembly 26 to clean the filter 38. The frame 36 may be fabricated from plastic materials and/or numerous and varied alternative materials that are well known in the art.

In the illustrated embodiment, the filter assembly 26 may have a square shape, or in alternative embodiments, the filter assembly 26 may have any geometric shape that extends across and covers the intake port 24. Further, in the illustrated embodiment, the filter assembly 26 may have a flat (or planar) profile. In alternative embodiments, the filter assembly 26 may have numerous and varied profiles. By way of example only, the filter assembly 26 may have a concave profile toward the canister side of the filter assembly 26. In this way, the effective cleaning area of the panel filter 26 may be increased. The filter assembly 26 may be accessed via a door 42 mounted on either the canister 12 or the vacuum head 14. In this example embodiment, the bottom side of the door 42 may be hingedly coupled to the canister 12. The top side of the door 42 and the canister 12 may include conventional features such as latches and/or cooperating ribs, that cooperate to provisionally secure the door 42 in a closed condition. In alternative embodiments, another side of the door 42, other than the bottom side, may be hingedly coupled to the canister 12. For example, a lateral side of the door 42 may be hinge coupled to the canister 12 so that the opposite side surface of the door 42 may be swung open. In the alternative embodiments, the door 42 may be slidably mounted in opposed grooves provided in the canister 12, and without using any hinge couplings.

Figure 3:
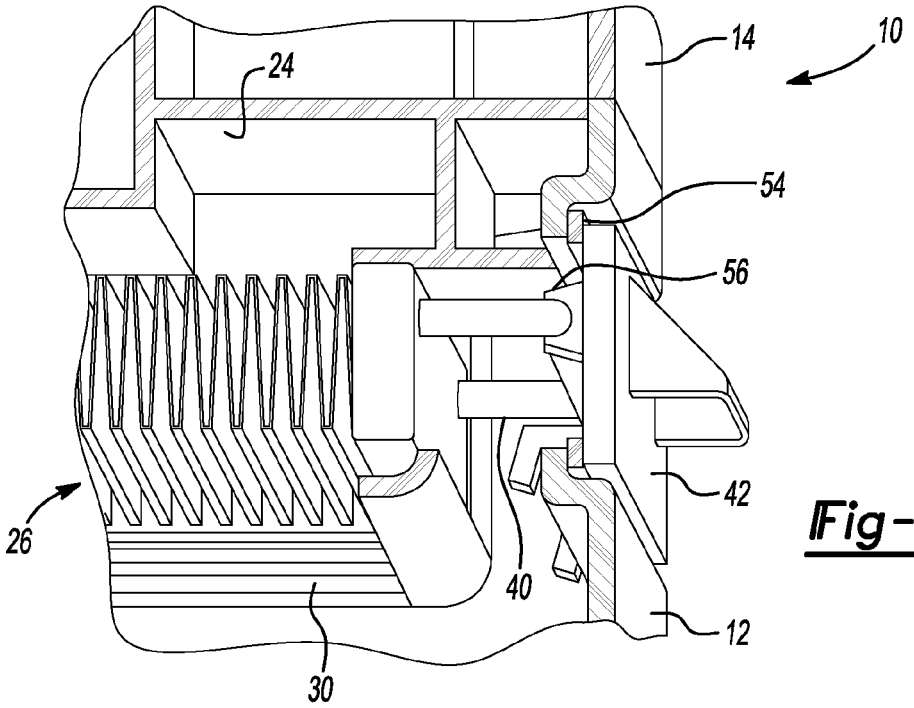
FIG. 3 is a cut away perspective view illustrating the removable filter tray and access panel of a shop vacuum according to the principles of the present disclosure.
Figure 4:
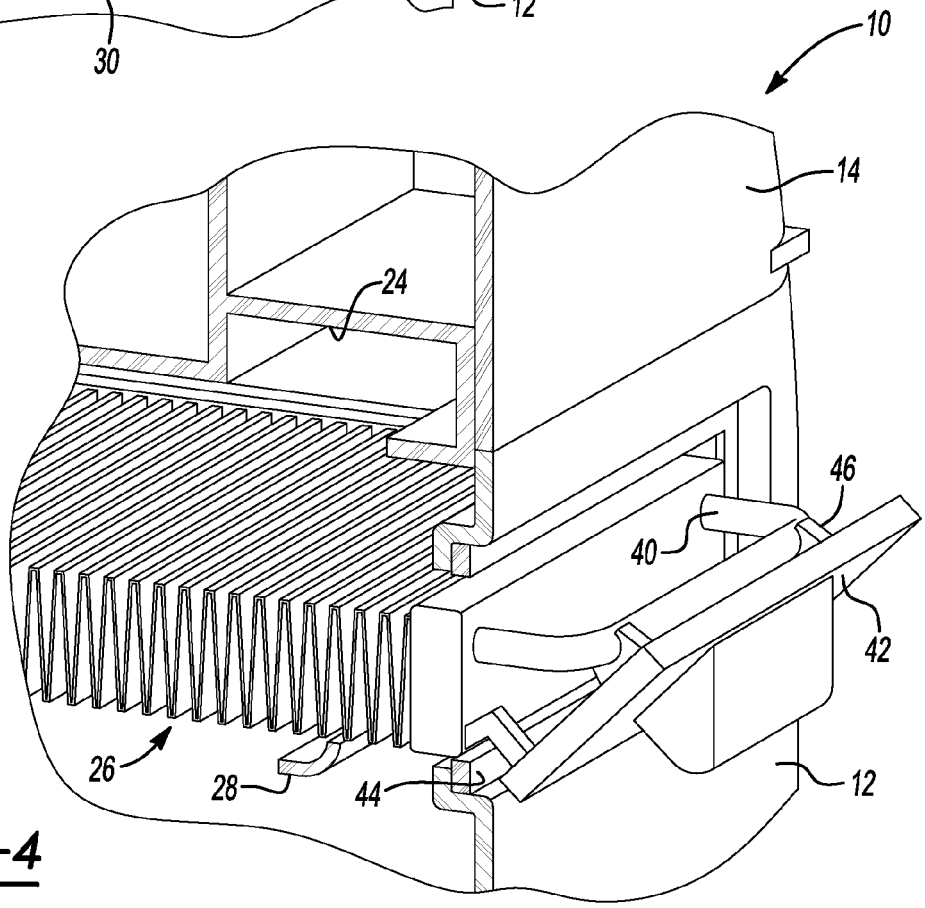
FIG. 4 is a partial sectional perspective view illustrating the removability of the filter tray, according to the principles of the present disclosure.

With reference to FIG. 3, a gasket 44 may be interposed between the canister 12 and the door 42 to improve air-tightness. The gasket 44 may be mounted on the canister 12, as shown. Alternatively, the gasket 44 may be mounted on the door 42. The door 42 may include a saddle 46 that interacts with the handle 40 to improve air-tightness between the filter assembly 26 and the intake port 24. For example, in the partially open condition of the door 42 depicted in FIG. 4, the saddle 46 may abut against the handle 40. When the door 42 is moved to the closed condition depicted in FIG. 3, the saddle 46 may push the filter assembly 26 laterally into the filter housing 28 of the vacuum head 14. The saddle 46 may also push the filter assembly 26 upward and against the intake port 24 due to the arcuate travel path of the door 42.

A user may gain access to the filter assembly 26 without having to remove the vacuum head 14 from the canister 12. For example, the user may open the door 42, grab the handle 40, and pull the filter assembly 26 out of the filter housing 28. The user may then shake and/or bang the filter assembly 26 to remove debris from the panel filter 38 or to replace the filter 38 with a new one. Further, the low profile filter assembly 26 may increase the capacity of the canister 12.

Figure 7:
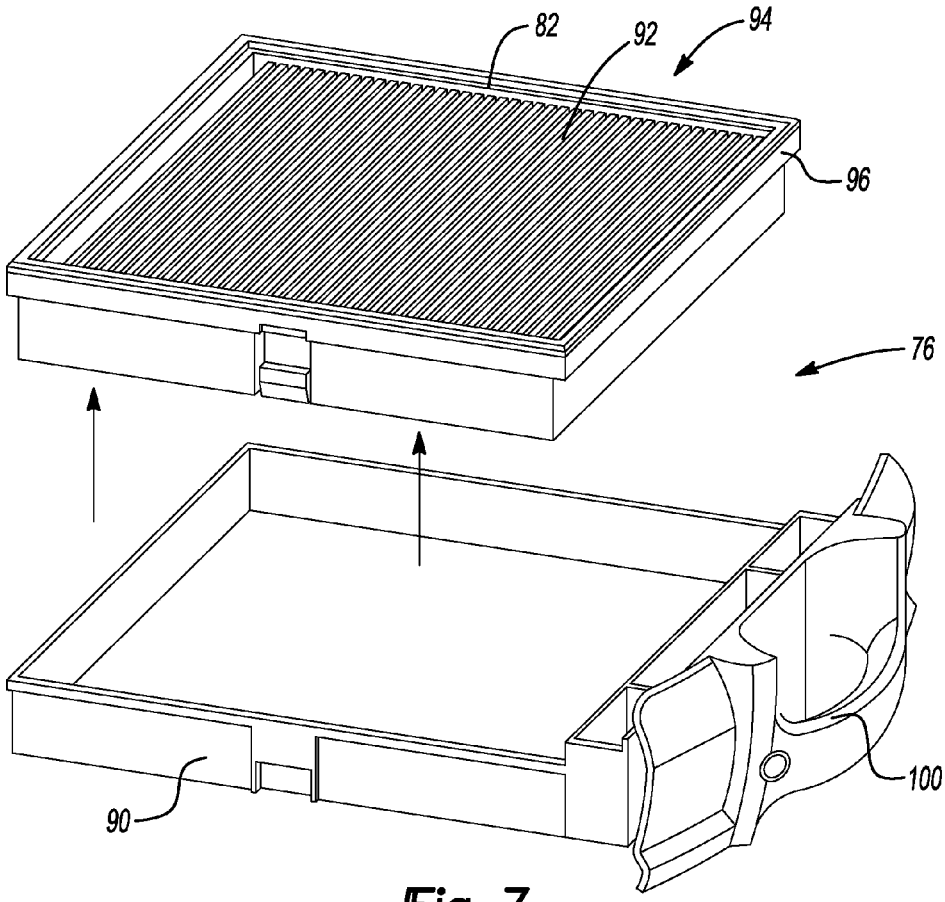
FIG. 7 is a perspective view illustrating the filter insert cartridge removed from the removable filter tray according to the principles of the present disclosure.
Figure 8:
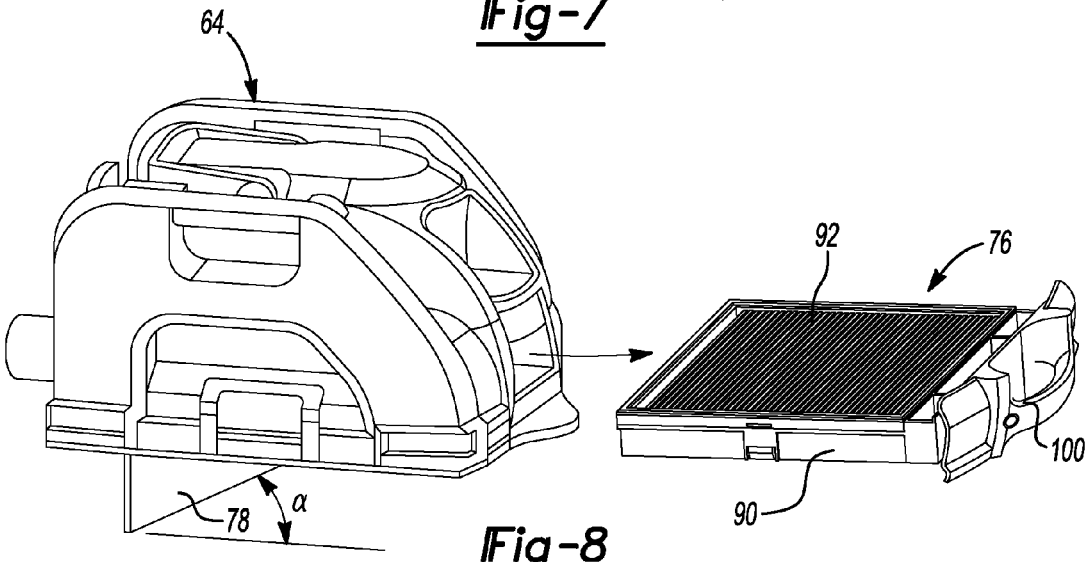
FIG. 8 is a perspective view of the vacuum head, illustrating the insertion angle of the removable filter tray according to the principles of the present disclosure.
Figure 9:
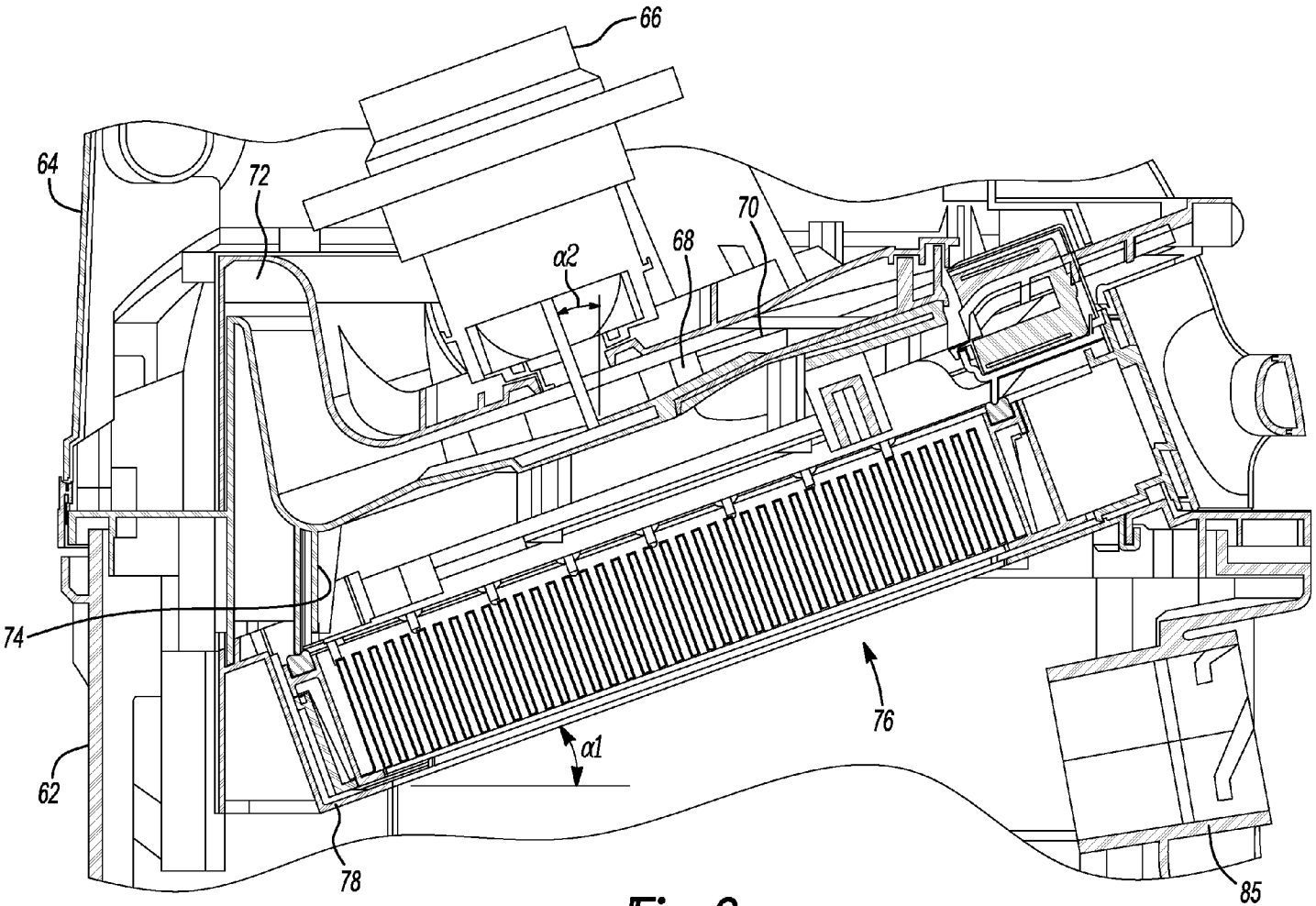
FIG. 9 is a cross-sectional view illustrating the removable filter tray received in the vacuum head as well as illustrating the angled orientation of the motor and vacuum impeller according to the principles of the present disclosure.
Figure 10:
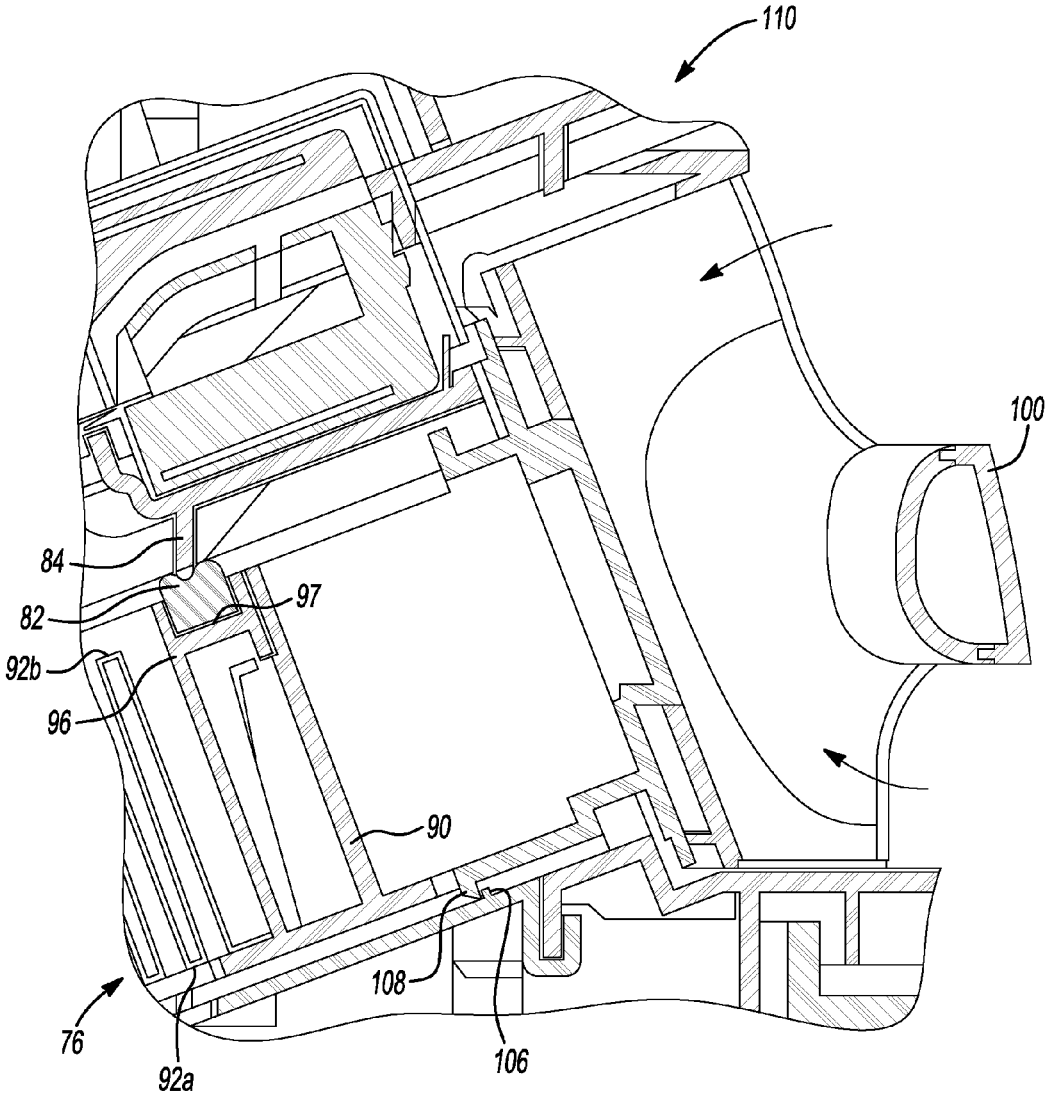
FIG. 10 is a detailed cross-sectional view illustrating the sealed relationship between the filter tray and vacuum housing according to the principles of the present disclosure.
Figure 11:
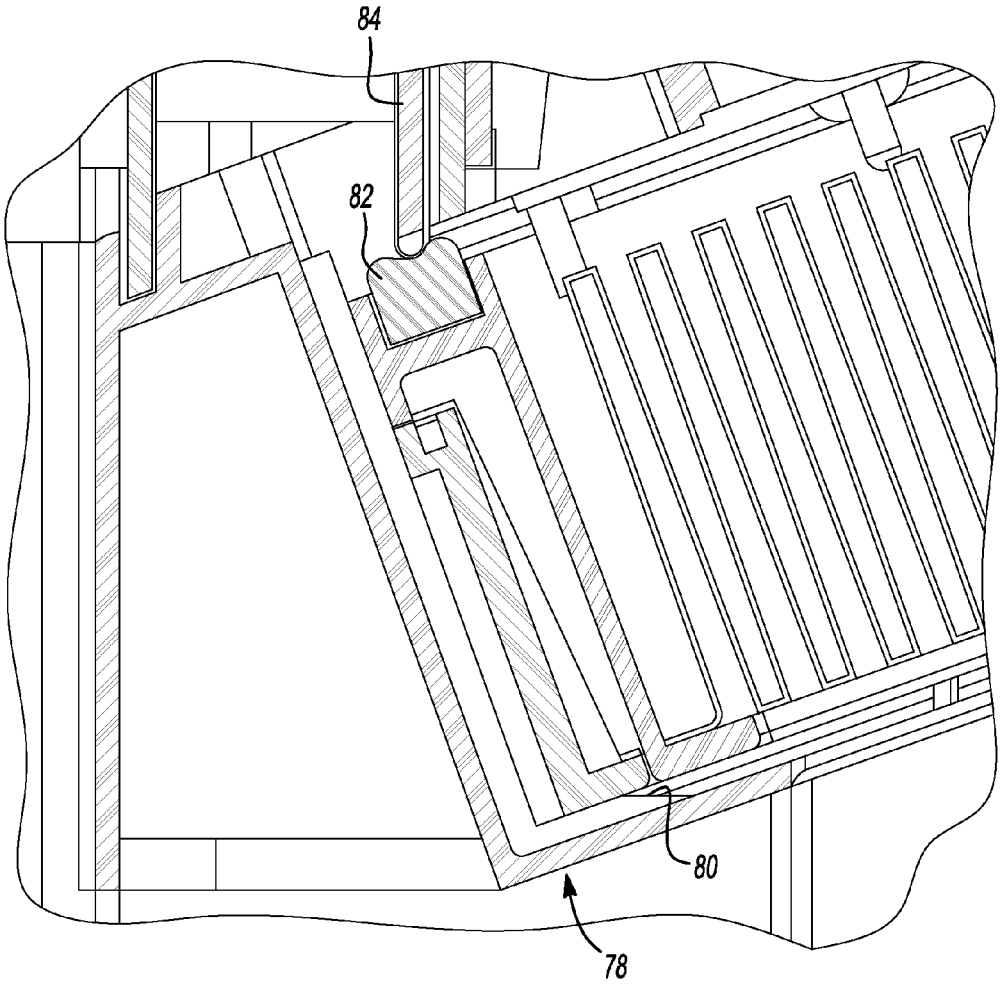
FIG. 11 is a detailed cross-sectional view illustrating the sealed relationship of the innermost portion of the removable filter tray and the vacuum housing according to the principles of the present disclosure.

With reference to FIGS. 5-11, a second example vacuum 60 will be described. The vacuum 60 includes a canister 62 and a vacuum head 64 that closes the canister 62. As shown in FIG. 9, the vacuum head 64 may support a drive motor 66. The drive motor 66 may support a suction fan 68, which may be provided in a fan chamber 70 of the vacuum head 64. The fan chamber 70 may be in fluid communication with an exhaust port 72 and an intake port 74. The intake port 74 may be covered by a filter assembly 76 situated in a filter housing 78 of the vacuum head 64. The filter housing 78 may include a ramp 80 that may influence the filter assembly 76 toward and into engagement with an opening of the intake port 74. In particular, as illustrated in FIG. 11, the ramp 80 provided on the interior surface of the filter housing 78 directs the filter assembly 76 in an upward direction so that a continuous gasket 82 provided around the perimeter of the filter engages a projecting rib 84 surrounding the intake opening 74 to provide a sealed connection between the filter assembly 76 and the intake opening 74. The gasket 82 is also shown in FIG. 10 engaging the projecting rib 84 at the proximal end of the filter assembly 76.

The motor 66, when powered up, may rotate the suction fan 68 to draw air through a suction inlet 85 into the canister 62, from the canister 62 through the filter assembly 76, through the intake port 74 and into the fan chamber 70. The suction fan 68 may push the air in the fan chamber 70 through the exhaust port 72 and out of the vacuum 60.

Figure 6:
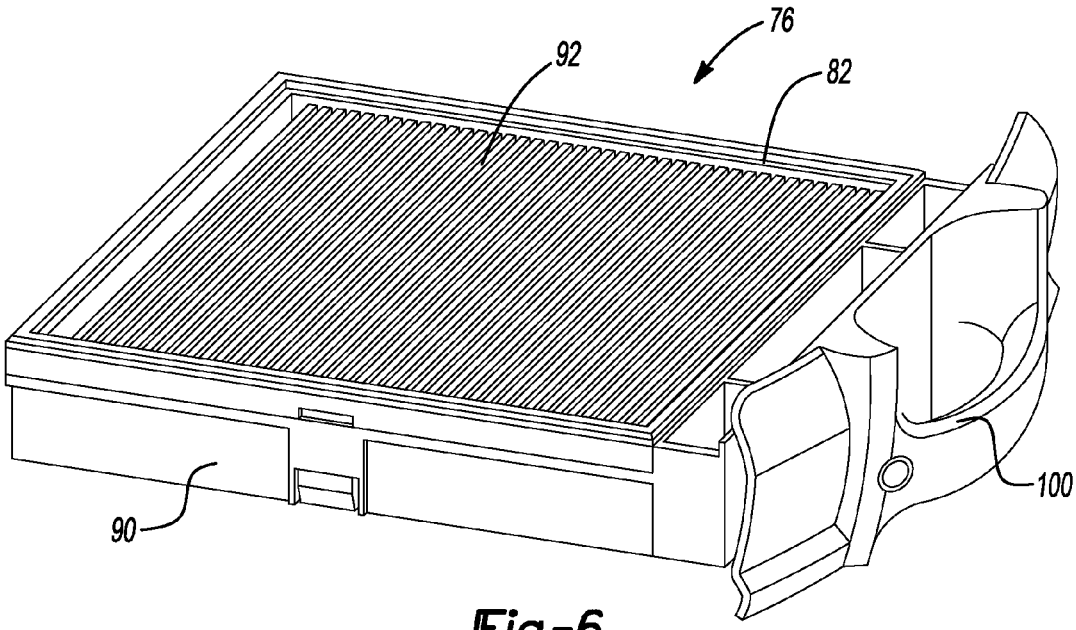
FIG. 6 is a perspective view of the removable filter tray according to the principles of the present disclosure.

With reference to FIGS. 6 and 7, the filter assembly 76 may include a frame 90 supporting a panel filter 92. In the disclosed embodiment, the panel filter 92 may be a corrugated paper filter having a plastic, elastomeric or rubber frame portion 96 surrounding the corrugated paper filter. The frame portion 96 can include a recess 97 therein for receiving the gasket 82 therein. Alternatively, the gasket 82 and frame portion 96 can be integrally formed in order to eliminate additional components. In this case, the combined filter frame and gasket can be formed from a soft elastomeric material in order to encourage a sealing engagement between the gasket and the projecting portion 84 surrounding the intake passage 74. In alternative embodiments, the panel filter 92 may be fabricated from numerous and alternative materials that are well known in the art. The panel filter 92 may include an input side 92*a* that faces away from the intake port 74 and an output side 92*b* that faces into the intake port 74.

As shown, the tray frame 90 may include a handle 100. In this example embodiment, the frame 90 and the handle 100 may be of a unitary one-piece construction. In alternative embodiments, the frame 90 and the handle 100 may be separate and distinct components that are assembled together. The frame 90 may be fabricated from a material with sufficient rigidity to allow a user a grasp the handle 100 and shake and/or bang the filter assembly 76 to clean the filter 92. The frame 90 may be fabricated from plastic materials, and/or numerous and varied alternative materials that are well known in the art.

In the illustrated embodiment, the filter assembly 76 has a rectangular shape. However, the filter assembly 76 may have any geometric shape that extends across and covers the intake port 74.

Figure 5:
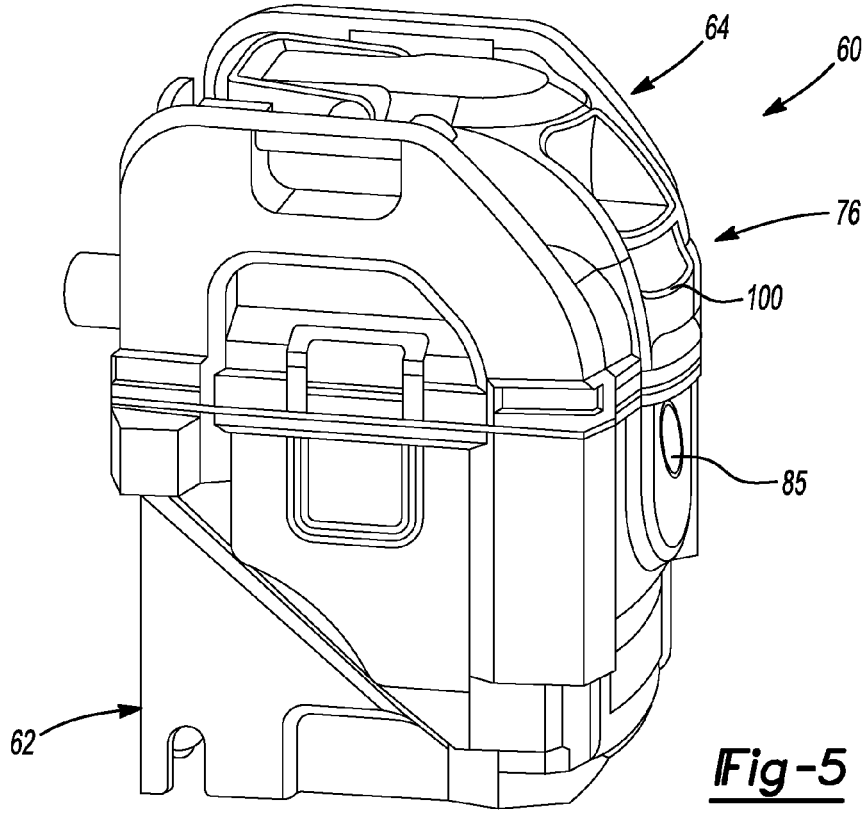
FIG. 5 is a perspective view of a shop vacuum incorporating a removable filter tray according to the principles of the present disclosure.

The filter 76 may be accessed via the handle 100 which is exposed to the exterior of the vacuum 60 as illustrated in FIG. 5. The filter assembly 76 is slidably received within the filter housing 78 as illustrated in FIG. 8. As illustrated in FIG. 8, the insertion direction of the removable filter tray 76 can be disposed at an angle $\alpha_1$ which can be between 10 and 45 degrees relative to horizontal an angle of. Thus, the filter housing 78 of the vacuum head 64 may extend downward into the canister 62 at the filter housing's most inward end. The angled orientation of the filter tray assembly 76 thus allows the motor 66 and suction fan 68 to be oriented such that the drive shaft 67 of the motor 66 is disposed at the angle $\alpha_2$ relative to vertical, as illustrated in FIG. 9. The angel $\alpha_2$ can be between 10 and 45 degrees relative to vertical, or if preferred, out of line. The angles $\alpha_1$ and $\alpha_2$ can be the same or approximately the same as one another although they can also be varied from one another. The angled orientation of the filter tray assembly 76, the electric motor 66 and suction fan 68 allows the overall stack height of the motor, fan and filter to be reduced in the vertical direction in order to minimize the overall height of the vacuum 60. Furthermore, the angled orientation of the filter assembly 76 allows the filter to be oriented more inline with the suction inlet 85 of the canister 62, as illustrated in FIG. 9. With reference to FIG. 10, it is noted that the filter housing 78 can be provided with projecting ribs 106, which engage a corresponding projecting rib 108 provided on the surface of the tray 90. The projecting ribs 106 and 108 engage one another in order to secure the tray 90 within the filter housing 78. The ribs 106,108 provide the user with a tactile indicator letting them know that the tray 90 is properly inserted into the filter housing 78. Additional seals 110 can be provided for sealingly engaging the handle portion of the tray against the opening leading into the filter housing 78. This sealed connection prevents air from being drawn into the vacuum around the opening of the tray housing thus, eliminating undesirable noises and reductions in vacuum pressure utilized for picking up debris.

What is claimed is:

1. A vacuum, comprising:

a housing defining a suction inlet opening and a debris chamber in communication with said suction inlet opening;

a vacuum pressure source disposed in said housing for providing a vacuum pressure to said suction inlet opening;

a removable filter tray accessible from an exterior of said housing and disposed in an airflow path between said suction inlet opening and said vacuum pressure source, wherein said housing includes a base canister portion defining said debris chamber and a head portion removably secured to said base canister portion and including an aperture, said removable filter tray is inserted into the aperture in said head portion and into a guide channel extending from said aperture, said removable filter tray is received in said aperture in said head portion and into said guide channel along an insertion direction that is angled relative to horizontal such that said insertion direction forms an acute angle with a vertical sidewall of said base canister portion, said guide channel including a sloped surface extending at an acute angle therefrom for pressing said removable filter tray against an impeller inlet to provide a sealed connection between said removable filter tray and said impeller inlet.

2. The vacuum according to claim 1, wherein said removable filter tray includes a tray frame having a handle accessible from said exterior of said housing.

3. The vacuum according to claim 2, wherein said tray frame provides a sealed engagement with said aperture in said housing.

4. The vacuum according to claim 1, further comprising a filter insert received in said removable filter tray.

5. The vacuum according to claim 1, wherein said insertion direction is angled between 10 degrees and 30 degrees relative to horizontal such that said insertion direction is correspondingly angled between 80 and 60 degrees relative to said vertical sidewall of said base canister portion.

6. The vacuum according to claim 1, wherein said guide channel extends into said base canister portion at an acute angle relative to said vertical sidewall of said base canister portion.

7. The vacuum according to claim 6, wherein said acute angle relative to said vertical sidewall is between 60 and 80 degrees.

8. The vacuum according to claim 1, wherein said sloped surface presses said removable filter tray against said impeller inlet to provide a sealed connection between a filter insert in said removable filter tray and said impeller inlet.

9. The vacuum according to claim 8, wherein said vacuum pressure source includes an electric motor and an impeller driven by a drive shaft of said electric motor, said drive shaft being generally perpendicular to an insertion direction of said guide channel.

10. A vacuum, comprising:

a housing defining a suction inlet opening, a debris chamber in communication with said suction inlet opening, and a filter housing;

an electric motor and an impeller driven by a drive shaft of said electric motor, said electric motor and said impeller being disposed in said housing for providing a vacuum pressure to said suction inlet opening, said drive shaft being rotatable about an axis angled between 10 and 30 degrees from vertical; and a removable filter disposed in said filter housing in an airflow path between said suction inlet opening and said electric motor and impeller, said filter housing including a projecting rib arranged to engage another rib projecting from the filter so as to secure the filter to said filter housing.

11. A vacuum comprising:

a housing defining a suction inlet opening and a debris chamber in communication with said suction inlet opening;

an electric motor and an impeller driven by a drive shaft of said electric motor, said electric motor and said impeller being disposed in said housing for providing a vacuum pressure to said suction inlet opening, said drive shaft being rotatable about an axis angled between 10 and 30 degrees from vertical; and a removable filter disposed in an airflow path between said suction inlet opening and said electric motor and impeller such that said removable filter is positioned generally perpendicular to the axis of the drive shaft, said filter including an upper surface and a lower surface generally parallel to said upper surface, said upper and lower surfaces of said filter each being in a plane generally perpendicular to said axis of said drive shaft, said filter having a tray frame with a handle accessible from an exterior of said housing;

wherein said housing further comprises an aperture for providing access to said tray frame, and a door hingedly coupled to the housing and arranged to provide access to the aperture, the door including a saddle arranged to engage the handle when the door is in a closed position so as to urge said tray frame against an impeller inlet to provide a sealed connection between said tray frame and said impeller inlet.

* * * * *